United States Patent [19]

Morrell

[11] 4,105,536

[45] Aug. 8, 1978

[54] PROCESSES INCLUDING THE PRODUCTION OF NON-CONGEALING SHALE OIL FROM OIL SHALES

[76] Inventor: Jacque C. Morrell, 4501 Connecticut Ave., NW., Apt. 516, Washington, D.C. 20008

[21] Appl. No.: 769,885

[22] Filed: Feb. 18, 1977

Related U.S. Application Data

[63] Continuation-in-part of Ser. No. 679,315, Apr. 23, 1976, abandoned, which is a continuation-in-part of Ser. No. 455,074, Mar. 27, 1974, Pat. No. 3,954,597.

[51] Int. Cl.[2] ..... C10G 1/02

[52] U.S. Cl. ..... 208/11 R; 201/16; 201/43; 202/131; 202/136

[58] Field of Search ..... 208/11 R

[56] References Cited

U.S. PATENT DOCUMENTS

| | | | |
|---|---|---|---|
| 3,484,364 | 12/1969 | Hemming et al. | 208/11 R |
| 3,691,056 | 9/1972 | Barney et al. | 208/11 R |
| 3,925,190 | 12/1975 | Whitcombe et al. | 208/11 R |
| 3,954,597 | 5/1976 | Morrell | 208/11 R |

*Primary Examiner*—Herbert Levine

*Attorney, Agent, or Firm*—Larson, Taylor and Hinds

[57] ABSTRACT

Oil Shale is partially dehydrated prior to retorting. Both the dehydrating and retorting steps carried out by heat treatment in rotating horizontal cylindrical vessels heated by indirect heat exchange with hot gas. The vapors withdrawn from the retorting step are fractionated to yield products including a heavy conversion oil.

9 Claims, 6 Drawing Figures

PROCESSES INCLUDING THE PRODUCTION OF NON-CONGEALING SHALE OIL FROM OIL SHALES

BACKGROUND OF THE INVENTION

The present invention is a continuation-in-part of that described in Ser. No. 679,315 filed Apr. 23, 1976 now abandoned which in effect is a CIP of Ser. No. 455,074 filed Mar. 27, 1974 and now issued May 4, 1974 as U.S. Pat. No. 3,954,597 mainly in the present case, to improve the capacity of the retort section of the process, as well as the balance, in this respect with the process as a whole. In this sense, the improvement with respect to retorting capacity and fuel economy in combination with the improvement of the shale oil product by Visbreaking is a new and novel one in the art of oil shale on an industrial scale in "project independence" to replace our rapidly diminishing supplies of petroleum.

DESCRIPTION OF THE PRIOR ART

The prior art regarding oil shales relates mainly to the design and operation of oil shale retorts in Scotland and France and more recently in Australia as well as some lesser operations in other countries. The above foreign experience goes back for more than a century and some improvements have been made mainly in surface retort design largely on a repetitious pilot plant basis; and some inconclusive underground retorting; therefore there is little basis of comparison between the prior art of the past with the requirements of the future oil shale industry in the United States. The reason for this is because of the very limited objectives of the past both with regard to type and variety of products and uses of the same as well as the required capacities demanded. To cite the Scottish experience, which is the best, particularly from the viewpoint of plant design, their objectives were to make maximum yields of both ammonia as well as refined oil products; (including lubricating oils, kerosene and waxes). These objectives in addition to plant design seriously limited capacities of the retorts, on the basis of present and future requirements as the results with respect to the latter were far below requirements for projected U.S. products and practices even including those of the improvements made in the last half century. Comparison of foreign results referred to above because of the era and completely different present objectives as indicated above, cannot be made. Development, including some worthy research in the subject, generally in the United States, over the past 50 years has been limited with regard to production mainly to pilot plant retorts of a variety of designs; the merits of most of which from the viewpoint of present requirements very largely remain to be proven. No unitary and continuous process comparable to that shown herein and related developments has been disclosed in the prior art.

SUMMARY OF THE INVENTION

The abstract of the disclosure above is a brief summary of the invention which does not, however, describe the necessary details to show flexibility and continuity over long periods demanded from the process as is shown below. It does, however, outline the basic principles of the invention as disclosed in sections A and B of FIGS. 1, 1A and 2, which represent respectively in outline the retorting and "Visbreaking" sections of the process of the invention. In addition to the above, additional and alternative features are shown in FIGS. 3 and 4. The main features are, however, intended to remedy the capacity aspects of the oil shale retorts of the prior art when applied to projected United States requirements with respect to types and quantities of products for modern needs; and pretreatment when necessary of the shale oil to permit ready transfer by pipeline to the refinery for further processing into marketable products. This includes the equipment and process, novel unitary and continuous for mass production to which the invention is directed, with later conversion at the refinery to principal distillate products referred to in my recently issued U.S. Pat. No. 3,954,597, as well as additional improvements regarding the capacity and thruputs to meet the aforesaid demands: with maximum economy and simplicity of operation consistent with the tremendously important objectives of national security and independence.

PREFERRED EMBODIMENTS

FIG. 1, in essence, embodies the general principles of the preferred "retorting" process, namely, the horizontal rotary type partial dehydrator and in general of the retort, illustrated in FIG. 1. The other type of retort shown here in FIG. 3 is useful but not preferred and is not necessary to illustrate the improvements shown herein. FIG. 1 shows the details of the equipment necessary for the process, the flow of which is illustrated in FIG. 1A embodying two similar substantially horizontal vessels and steps of the process set forth in the abstract, namely, the removal and recovery of a substantial amount of the water and light hydrocarbon distillate in the first or partial dehydration step, and the remainder of both the latter and the heavier oil product at substantially higher temperature in the second retort and step of the process. Following this is the separation and recovery of the low boiling products and Visbreaking and recovery of the heavier product as illustrated in FIG. 2.

BRIEF DESCRIPTION OF THE DRAWINGS

The drawings are illustrated and discussed in connection with the numbers of the figures, which in turn are directed to various aspects of the process of my invention, and the equipment and means used in connection therewith. FIG. 1A section 3 is the preheating and drying section of the process wherein the oil shale is preheated to remove a substantial and/or a major portion of the water present in the oil shale both in free or combined form by subjecting the same to elevated temperatures, but lower than those maintained in section 3', employing in part waste hot gases from the retort heater in section 3' to heat the oil shale so as to remove a large or major portion of the water. This takes place along with some low boiling hydrocarbon distillate and reduces the burden of water removal from the principal shale oil 3' retort, and at the same time the capacity of the latter is substantially increased.

Section B.

Figure 1:
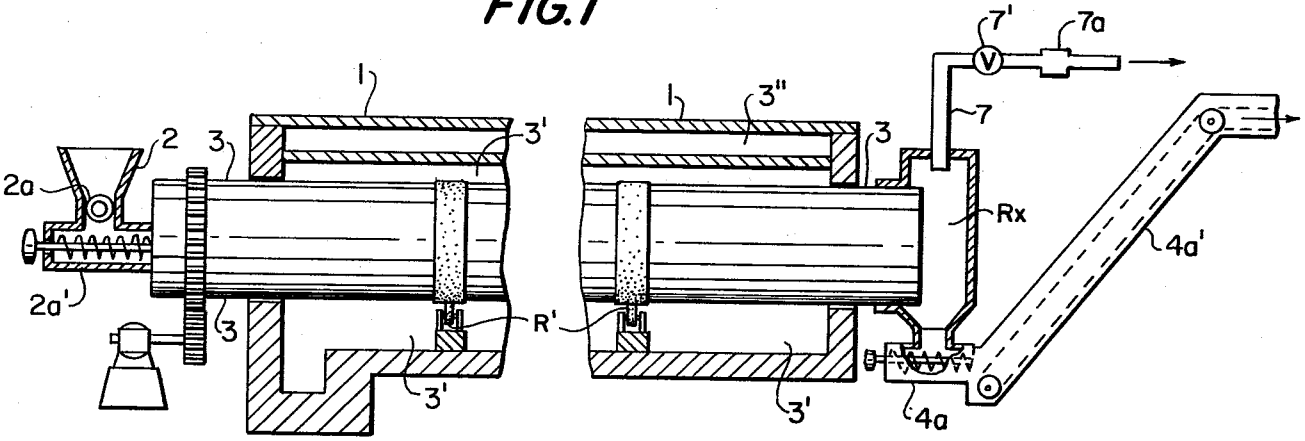
FIG. 1 shows the details of both sections 3 and 3' FIG. 2 section A depicts the fractionator and partial condenser which permits separation of an overhead product from both sections 3 and 3' consisting of a light oil distillate comprising gasoline and water which are condensed and collected in a receiver; as well as ammonia and hydrocarbon gases which are recovered, the latter being utilized as fuel. The major heavier oil product collects in the bottom of the fractionator and is pumped while hot to the viscosity breaking section B (FIG. 2) of the process for conversion of the heavy shale oil fraction to a product which may be readily transferred without congealing to a refinery for further processing to fuel distillates as described in the present application Ser. No. 679,315.
Figure 1A:
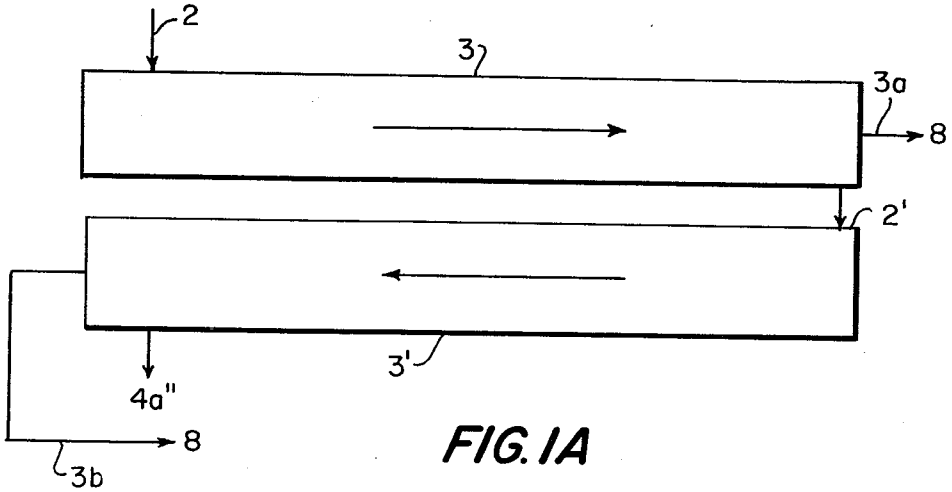
FIG. 1A, essentially a flow sheet, is divided into sections 3 and 3' for convenience of description and discussion.
Figure 1B:
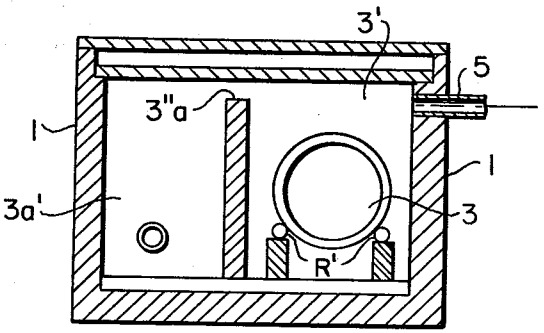

It is noted here that FIG. 1B represents a cross section of FIG. 1 depicting a rotary retort and furnace.

Figure 3:
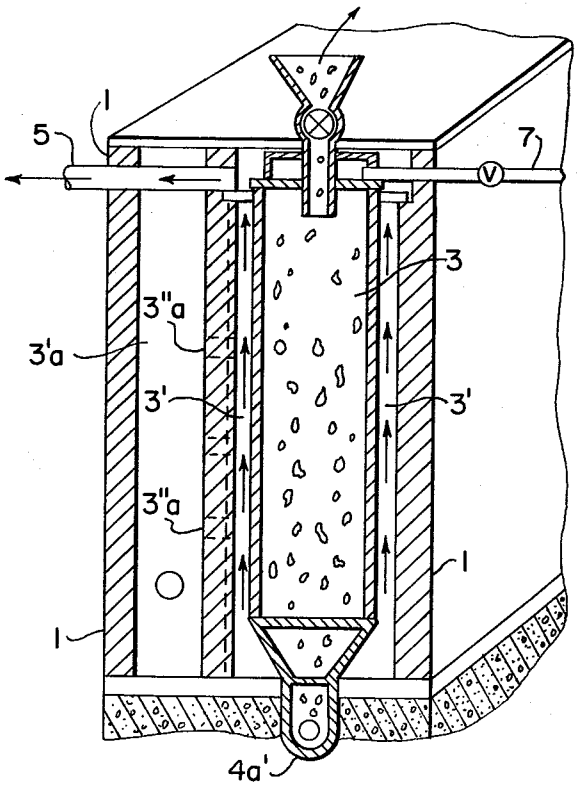
Figure 2:
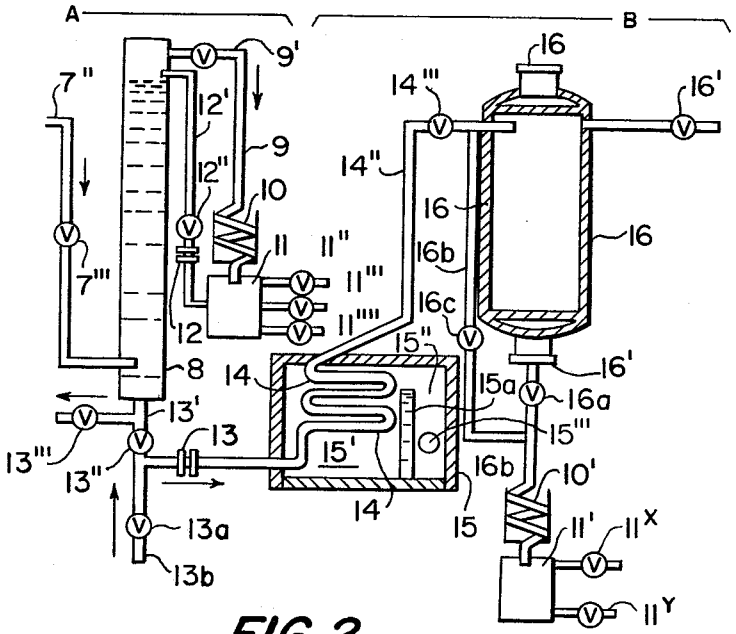
FIG. 2 is the viscosity breaking section of FIG. 2 which together with Section B, FIGS. 1 and 1A consisting of the oil shale retorts and the fractionator, etc. constitute a unitary and continuous process for the production of superior shale oil product from which the gasoline and water have been removed and recovered and which may be readily transferred to the refinery from which the finished distillate products may be obtained by a simple process of cracking and refining disclosed by me in the parent case referred to above.

FIG. 3 relates to an alternate vertical tubular oil shale retort design with ceramic and/or fire brick setting preferably arranged as a battery of retorts to balance the capacity of the viscosity breaking section of FIG. 2. The horizontal type of rotating retort, however, has special merit as the preferred type. In general, the retorts are intended to be fully equipped with gas producers and other sources of by-product fuel and conveyors as illustrated in FIG. 1 and in general as needed and as more fully described below.

The invention generally relates to the treatment of oil shales to provide raw material for oil distillate products therefrom and more particularly relates to the process of treating the said oil shales in a relatively economical, practical unitary and substantially continuous process to produce an oil product which may be readily transferred to a refinery from the mine sources; and to produce directly by cracking, and other operations at the refinery to produce various distillate products including gasoline and fuels generally for air craft and automotive vehicles, and burning or heating oils suitable as domestic fuels, diesel oils, jet fuels and similar distillate fuels suitable for various uses including e.g., as raw materials for petrochemicals, etc., and as an alternate or substitute source for similar distillate products from petroleum. Moreover, it is intended to replace the latter and to meet the requirements thereof in all respects during critical periods such as the Middle East embargo aimed at a denial of necessary petroleum supplies; and in fact it will serve to replace petroleum products in the future when petroleum production and supply decreases; which is already a rapidly developing situation substantially below normal and in fact fails to meet minimum requirements; especially under embargo conditions. In any circumstances and from any viewpoint the time for developing an oil shale industry, is now!

With regard to the general subject of oil shale, from the mineralogical viewpoint, an oil shale is basically a rock of sedimentary origin (normally from clays) which has the composition structure and formation of a shale generally (although alternatively considered by some as having a marl base). However, it does not yield oil on extraction with solvents. Oil shale is black and dark brown and when broken is generally with a conchoidal fracture. It contains a substance generally referred to as "kerogen" which on destructive distillation by heat treatment at or somewhat above a dull red heat, and higher, produces an oil product generally similar to a hydrocarbon oil from petroleum, as well as hydrocarbon gas; and in addition, it produces nitrogen bases, and ammonia; the latter generally in aqueous solution, since water is also a product of the heat treatment.

Oil shales are found in very large amounts in several parts of the United States as well as in other locations throughout the world. The oil shale deposits in the Green River Formation in Colorado, Wyoming and Utah, etc., are generally of good quality and occur in vast quantities, and as shown below, oil shales occur in other parts of the United States.

As a general guide the amounts of oil produced varies with the type of oil shale and conditions of treatment as well as other factors. As a further guide, a large percentage of the oil shale brought from the Green River Formation in Colorado, Wyoming and Utah and in some other parts of the United States may produce from 20 to 25 gallons (about one half barrel) per ton, and upward of 40 gallons per ton in some cases; although occasional beds in this formation may show about 60 to 90 gallons per ton on a selective basis. Comparable yields of oil from lesser known deposits may be found in Nevada and California, and to some degree in Montana. Oil shale deposits are also found in the Midwest and the eastern part of the United States, e.g., Illinois, Kentucky, Ohio, New York, Pennsylvania, West Virginia and Tennessee; and oil shale in the same general formation (Devonian) yielding notable quantities of oil have been reported in Missouri, Kansas and Oklahoma. The latter are of lesser quality with respect to yield of oil than the Green River Formation, i.e., about 16 gallons per ton.

Recent estimates, reported in connection with the embargo crisis, state that the oil bearing shale in the Green River Formation which runs through Colorado, Wyoming and Utah contains an estimated 600 billion barrels of shale oil, enough to fill the country's needs at current consumption levels for about 100 years, and of course, to this may be added estimates of the very considerable Devonian Formation.

Reports on mining oil shale indicate the practicality of the room and pillar method in the Green River Formation with the added advantage over coal of greater structural strength of oil shale and less liability of gas formation and explosions. The Devonian formation is amenable to strip mining having definitely in mind the environmental problem and at the same time the solutions which have been successfully applied thereto. Water is available, but, in general, the time has arrived when its proper allocation must be considered on a national basis; and known technology such as recycling, etc. applied as required. The Colorado River rises in the Green River Formation and the need for fuel distillates is definitely of significant national importance to warrant a technically controlled allocation.

It may be noted in connection with the present improvement of my invention that a typical oil shale, e.g., from the Green River Formation (Colorado, Wyoming and Utah) which may produce from 20 to 40 gallons of oil per ton (and in some cases as much as 90 gallons) may also contain a considerable amount of water, e.g., about one-quarter of the light oil. The oil is produced on heat treatment of the kerogen (the parent substance).

The latter under the microscope has a structure indicating its derivation from plant life. The water produced on retorting evidentally traces back to the underwater formation of the oil shale. It is well known that conversion of kerogen to oil by high temperature treatment is a chemical reaction; but it is not so well known that the water appears likewise to be "chemically or otherwise bound" because of the abnormally long time and high temperatures required to release the water.

Before proceeding to a detailed account of my present invention, the following is a brief description of some of the underlying principles which I have discovered relative to the present improvement, which is also in part the basis of the parent application Ser. No. 679,315 from the capacity viewpoint in the translation of the shale oil industry from the viewpoint of capacity to replace the petroleum industry as required.

I have found over a range of increasing temperatures that the water in oil shale does not exhibit its normal behavior as a single compound, e.g., boiling at a constant temperature. Moreover, its rate of release is considerably slower and continues to occur at much higher temperatures than "free water", but, of course, after release retains its normal properties. It does, however, evolve at a much more rapid rate than the production and/or release of the oil which incidentally is a mixture that has a wide range of boiling points.

Comparison in one set of tests showed that in the above connection at a maximum temperature of 860° F 6 hours were required to complete the distillation, or release on retorting; however, at a maximum temperature of 985° F the retort distillation or release of all the water and oil (at different rates) was completed in two hours. This is of significance in connection with the present invention in retorting oil shale illustrated in the partial dehydration and retort sections A, FIGS. 1 and 1A of the process especially from the viewpoint of capacity.

The following data in the above connection is significant with respect to the preliminary treatment of the oil shale to remove a substantial portion of the water for the purpose of control in increasing retorting capacity. In a series of tests on the relative rates of removal of water it was shown that in the first 2 hours of retorting at a maximum temperature of drying about 600° F, more or less than 50% of the total water was removed whereas only about 20% of the extractable total oil (low boiling) was removed under the same conditions. During a three hour period at a maximum of about 700° F, 72% of the water was removed and only about one-third of the oil removed. The rate of water removal at these comparatively lower preretorting temperatures are thus seen to be much greater than oil removal.

From the evidence set forth above, it is concluded that a period of about 2 hours at about 600° F (e.g. 550 ° to 650° F) is a suitable drying period to remove about one-half of the water present and at the same time, a light hydrocarbon distillate, and as noted above in this connection, increasing the temperature to about 700° F over a period of about 3 hours, 72% of the water is removed with about one-third of the oil. It is also noted in connection with the above that the source of heat employed to heat (preferably indirectly) the partial dehydration may be obtained from the hot stack gases from the retort furnace which relieves uses of any fuel or additional costs. Using the above procedure, as pretreatment, removes a very considerable burden from the retort, and thus increases its capacity by a very considerable amount.

It is noted that a large or major amount of the water present in the oil shale is removed in the first or partial dehydration step of the process (employing a rotating horizontal cylindrical vessel) and the remainder of the water together with the major amount of the oil is removed in the retorting step of the process (which as previously stated is likewise carried out in a retorting horizontal cylindrical vessel); however at a much higher temperature range. Moreover, by increasing the operating temperature of the retort from about 850° F to 900° F, up to 950° F to 1000° F or in general a range of 800° F to 1000° F. the above residence time in the retort is greatly reduced and the capacity increased accordingly. Furthermore, by simultaneous increase in the heating surface (by increasing the diameter) of the horizontal retort e.g. from about 3 to 4 feet up to 5 to 6 feet and simultaneously increasing the length from about 25 to 30 feet, up to 50 to 60 feet, results in a tremendous increase in the retort capacity over that contemplated or achieved in the past more particularly with the prehydration treatment. It is noted in this connection that residence time is only one factor in capacity. Among the latter as illustrated above are heating surface, diameter and length of the rotary heating vessel and heat transfer (greatly improved by the rotary motion) and as illustrated above by the design and operating factors.

The effect of the use of the above procedure results in the elimination of cumbersome and/or costly procedures (aside from questions about plant and operating costs, and in this regard the practicality of the process); and instead solves a most important problem in connection with the industralization of oil shale as a viable industry commensurate with that required to replace the petroleum industry.

Referring to FIG. 1 and the first stage of the flow 3 in FIG. 1A, which shows diagrammatically the main principles of the process in the first stage, presented for convenience of reference in the form of a flow chart divided into two sections, e.g., first the pretreatment of the oil shale in the cylindrical vessel in FIG. 1 and thereafter in a substantially identical cylindrical vessel under higher temperature conditions in section 3 FIG. 1A followed by fractionator 8 in FIG. 2, for separating the heavier shale oil fractions for further treatment in the viscosity breaking section (after separating the remaining water and light oil present) as previously described with accompanying gas producer to convert carbon in spent shale to gas as previously described in the related issued patent, as well as below for heating the retorts and means for disposing of the shale ash as shown in FIG. 1 thereof. Section B, the viscosity breaking system to convert the heavier liquid products from the retorting system as shown in FIG. 2 to a freely flowing product, all of which are a part of a unitary and continuous process to be more fully described below.

With particular reference to the flow diagram FIG. 1A, the oil shale is subdivided by crushing or otherwise breaking it into suitable sizes, e.g. from ¼ inch to 1 inch or more or less. It is then introduced into the first cylindrical vessel designated as 3 in FIG. 1A in effect a partial drying or dehydration system which in general consists of means for applying indirect heat, preferably from hot waste gases, etc., (such as combustion gases en route to the stack, e.g., from the retort or furnace in viscosity breaking in the Section B of the system) to heat the oil shale and to remove a substantial portion of the water (together with dissolved ammonia contained therein), and usually together with some light hydrocarbon distillate) which are then condensed and collected. Details of the cylindrical vessels employed are shown in FIG. 1 and a practically identical retort at a higher temperature is used to remove the heavy oil and recover the same for further treatment. The partially dehydrated oil shale is then fed into the main retort system 3' at higher temperatures to remove the remainder of the water and light oil as overhead products and more particularly the heavier topped crude shale oil, collected from the bottom of the fractionator, connected to the retort, which maybe then pumped while hot to the viscosity breaking Section B as an overall continuous process. It is noted therefore that Section A, FIG. 2 of the present invention is an integral part of the entire process which has both novelty and utility. It is especially noted that while a pre-drying apparatus, described under Section A was employed in the parent case Ser. No. 679,315; a large rotary cylindrical (horizontal) dryer, (e.g. about 5 to 6 feet diameter and 40 to 50 foot long or greater as found necessary) operated at high capacity under conditions described above, e.g. in tandem with a similar horizontal rotary retort both under the high capacity temperature conditions already described herein. However, other similar combinations may be employed, although the preceding is preferred.

The foregoing is a statement of basic principles and preferred types of equipment of my invention. The following relates to the horizontal rotating cylindrical equipment as shown in FIG. 1 employed in tandem for partial dehydration and retorting as shown in the flow diagram in FIG. 1A. Referring to FIG. 1 the shale which is fed in through hopper 2, the latter being equipped with feed mechanism 2*a* which permits the oil shale to pass into the retort 3 while preventing the gases and vapor evolved in the retort from escaping. The oil shale which is previously crushed to suitable sizes of pieces, preferably from about ½ inch to 1 inch more or less, and utilizing the fines, e.g. down to ¼ inch and less for retorting. The cylindrical vessels both dehydration and retort (which in the present case are of the horizontal rotary type e.g. FIG. 1) may be arranged in a battery of several units (e.g. in tandem pairs for partial drying and retorting as in FIG. 1A) convenient to meet production requirements and to maintain a balance between capacities of the partial dehydrators and retorts in Section A and the viscosity breaking unit in Section B. The latter, when found necessary as shown in flow sheet FIG. 2 is an integral part of the process which will serve generally a number of partial dehydrators and retorts, e.g. in a battery. Into the first horizontal rotating cylinder designated as 3, the flow diagram 1A the oil shale passes in for partial, dehydration and then into (the second cylinder retort to be heated and decomposed by the hot combustion gases (passing around the outside of the retort i.e. indirect heating of the oil shale) resulting from the combustion of fuel which may be, either or both, producer gas and gases as a product or by-product of the process. The producer gas referred to above may be made from the spent shale containing a high carbon content; as well as other types of carbonaceous materials if necessary and available e.g. coal, coke etc. Also other types of gas producers may be employed.

The ash from the spent shale may be used as fill in the mine, and may also be used for various useful products referred to below.

Figure 4:
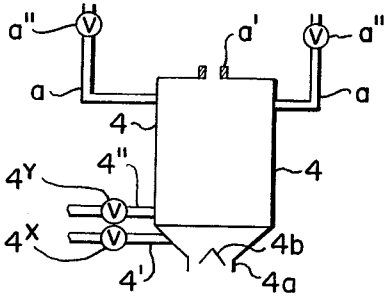
FIG. 4 illustrates a gas producer which is part of and supplies fuel to the retort system (FIGS. 1 and 1A), and the visbreaking unit, and which utilizes the by-product solid fuel consisting of spent oil shale to convert the carbonaceous material therein to producer gas as fuel for the process in addition to the hydrocarbon gases produced therein.

The fuel from the gas producer, FIG. 4, which in general employs by-product or other carbonaceous materials passes through lines *a* and *a'* around the outer surfaces controlled by valves *a''* and *a'''* with means for introducing steam and air and passes over the rotary cylindrical vessel to be burned in the annular space around the same in closely controlled coordination with air, employing, of course, the necessary safety and heat efficiency means. The air is supplied through lines *b* and *b'* controlled by valve *b''* and *b'''*. Lines *c* and *c'* provide fuel gas when needed from other sources. The burning gas around the rotary retort and hot gaseous products of combustion may pass the moving oil shale, (likewise illustrated) in concurrent flow, but out of contact with each other, to avoid mixing combustion gases with the oil vapors and product gases from the process, but in maximum heat transfer relationship with each other because of the rotary movement of both the retort oil shale undergoing treatment. The hydrocarbon oil vapors and gases which are the desired product of the reaction produced by the conversion of the major portion of the active oil forming substance in the oil shale (referred to as "kerogen", etc.) pass together with the oil shale, residue and are separated after leaving the rotating retort.

The drying system described in connection with the parent case (Serial No. 679,315) was designed to operate in conjunction with a number of rotary retorts, whereas in the present system and operation two rotary horizontal cylinders arranged in tandem or side by side as shown in FIG. 1A are employed the first functioning as a partial drying system, the second as a retorting system each under the conditions set forth above to accomplish the intended purpose of greater increased capacity of the retorts. This arrangement coordinated with the cracking section in the parent case; and with the viscosity breaking section in the present case makes a relatively inexpensive and convenient process package or unit which may be simply multiplied to achieve the very large capacities required for modern petroleum practice; more particularly since the capacity factor has been built in each unit as described above, or balanced in each unit as required.

Since essentially the same type of unit rotary retort as explained above may be employed under different conditions to accomplish the desired results, a detailed description of the equipment and operation is given below in connection with FIG. 1. FIG. 1 shows details of the rotating horizontal cylindrical vessel (suitable for use in both stages 3 and 3' in FIG. 1A) preferably sloping downward to induce passage and discharge of the oil shale undergoing treatment. The latter as explained is fed into hopper 2 with feed mechanism 2*a*, and additionally 2*a'*, and passes through the retort. The discharge and control mechanism 3 depends upon the slope and rate of rotation of the horizontal retort. The spent shale is carried out by screw and/or belt conveyor to the gas producer (discussed above) and shown as 4*a* and 4*a'* respectively. FIG. 1B above is a cross-section of FIG. 1. The remaining elements and numerals not already referred to in connection with FIGS. 1 and 1A are: line 7 controlled by valve 7' for passage of oil vapors and hydrocarbons gases to Fractionator 8 (FIG. 2) also line 5 in FIG. 1B for passage of combustion gases (7*a* in FIG. 1 is a fan to induce flow which may be used in all cases); special elements shown in FIG. 1 are: rotation elements comprising motor and gear mechanism (FIG. 1) and rollers upon which the horizontal retort rests, and receiver Rx and additional elements necessary for spent shale discharge and removal. Special elements, e.g. of the "star" type on the inside and movable along the bottom of the retort (not shown) or other arrangement may be found useful to prevent sticking of the heated oil shale on the inside and assist in removal of the same in connection with heat transfer. The arrangements of FIG. 1 and the other Figures may be varied as a matter of convenience with respect to location of the gas producer, etc., or source of heat generally, and the facilities supplied to transport the spent oil shale as well as for treatment of the ash for additional use or disposition. Location of the latter facilities is also a matter of choice and convenience.

With reference to FIG. 3, the notations on the drawing and explanations therein explain the various elements and the overall principles involved therein. In general, it is noted that FIG. 3 is a type of vertical retort (which is definitely not a preferred type but is cited for contrast and alternative availability), (generally intended to represent a battery of a number of units of the type depicted, to be used as alternative in some cases to the rotary type, all in the same setting and receiving their heat from the same source. It is further noted that the furnace or heating setting in FIG. 3 is a fire brick or similar ceramic material but the retort itself is iron or steel and as depicted in Section A to facilitate passage of the oil shale and residue. The general principle of heating is the same as used in general with respect to keeping combustion gases 3' separate in all cases from the oil vapors and hydrocarbon gases 3 (as illustrated in FIG. 1) resulting from the decomposition of the descending oil shale to produce oil and gas in the vertical retort.

The foregoing sets forth the underlying principles of the partial dehydration and retorting of oil shale in connection with my invention. The succeeding steps in the process are shown in Section A of FIG. 2 wherein the vapors and gases from the retort are passed through line 7" and 7"', the fractionator 8 to separate the heavier oil from the light distillate overhead fraction comprising mainly gasoline, together with hydrocarbon gases, water vapor and ammonia etc., all of which pass through the condenser 10 and into the receiver 11.

Note that there is still a considerable water content in the oil shale, which may be utilized where necessary, after recovery of ammonia contained therein, or used as a solution of the latter. Also nitrogen bases are present in the overhead product. The vapors of the overhead fraction (consisting principally of a light oil and aqueous fractions) may be passed through line 9 controlled by valve 9' and through water cooled condenser 10; and the resulting liquid and uncondensable hydrocarbon gases are then passed into receiver 11 from which the gases may be withdrawn through line and control valve 11'''. The water may be removed through line and valve 11''''. Line 11" on the receiver may be equipped with a fan or similar device which may be used as found necessary to create a slightly reduced pressure to induce the flow of gases. (The latter may prove expedient to assist in avoiding leaks within the retort.) The hydrocarbon gases withdrawn from the receiver may be washed free of ammonia (with water) which may be recovered as such or as ammonium sulphate useful as fertilizer, etc.

The liquids in the receiver comprise a heavier water layer which is withdrawn through line and valve 11''''. (It is noted that it may be desirable to remove gases to another separator or receiver, with suitable valve control, and from there to storage.) The light oil layer may be withdrawn through line and valve 11'''. Dissolved basic organic components in the water may be recovered. The light overhead distillate may be recovered and combined with the major distillate product of the process from Section B before refining the latter, or refined spearately as described below. A portion of the light distillate is recycled into the top of the fractionator, and the physical properties of the overhead distillate as well as that of the heavier oil condensate or reflux in the fractionator. The distillate from the receiver may be pumped through line and valve (12' and 12") into the top of the fractionator 8 to accomplish this objective. The heavier oil withdrawn from the bottom of the fractionator through line 13' and through suitable pump 13 for the viscosity breaking stage of the process; or if desirable or necessary through line and valve 13''' to be sent to storage after cooling or by heat exchange. Line 13*b* controlled by valve 13*a* may be used to pump stored oil for viscosity breaking when necessary or desirable.

Reverting now to the heated oil from the retort Section A and more particularly from the bottom of the fractionator 8 in Section A, of the process to the Section B viscosity breaking, also in FIG. 2, the heavier oil reflux and/or condensate from the bottom of the fractionator 8 is withdrawn through line 13' and valve 13" from the latter by high pressure hot oil pump 13 and pumped at relatively high pressure into heating coil 14 (generally referred to as heating tubes) with return bends or elements which serve this purpose, (generally suitable threaded elements fitted with threaded plugs) which permit cleaning the heating tubes periodically.

The oil entering the heating tubes is raised to visbreaking conditions of temperature and pressure e.g. in the range of about 700° F to 900° F; under a pressure in the range of about 100 to 200 pounds and above. Some illustrative results are shown in the examples below at 800° F and 150 lbs. pressure. The necessary time to bring about the desired changes is supplied by the rate of flow in the heating coil and visbreaking chamber. The heating tubes, generally made of alloy steel to prolong their life, (with arrangements for cleaning) are located in a furnace setting 15 divided into two sections by partition 15*a* which permits hot gases to pass into the other section referred to as the heating and combustion section respectively 15' and 15". The firing port is designated at 15'''. Heating may be done with gas using producer gas from the spent shale or hydrocarbon gas from the retorting process or from the visbreaking process, or a mixture, and other available beat sources as desired; generally obtained as a product (or by-product) of the process an example of the latter is the use of the highly heated waste combustion gases leaving the combustion zone of the oil shale retort for required partial dehydration; and available to a very considerable extent for heat exchange with the hot oil leaving the fractionator prior to visbreaking with a sufficient availability of the various gasesous fuels mentioned above to take care of all needs on a balanced basis. The highly heated oil at viscosity breaking conditions, is passed through line 14" controlled by valve 14''' and is discharged into the viscosity breaking chamber 16 (likewise under pressure) which may be controlled by valves 16" and 16*a*. The hydrocarbon liquid and gases may be withdrawn from line and valve 16" for desired treatment in the vapor phase (e.g. with the oil shale ash) to partially refine the same, but generally it is passed through line and valve 16*a*, through the cooler, and condenser coil 10' and the receiver 11, line 16b controlled by valve 16c may divert hot oil. (It is noted that the heating coil and chamber may be so designed in some cases to be transferred from location to location at the mine site in which case the chamber may be relatively of smaller diameter disposed horizontally on a flat car, and operated under somewhat higher pressure on a once-through basis.) Valve (and line) 11$^x$ is the principal pressure control system and releases the hydrocarbon gas produced in the visbreaking process which is passed to storage with the gases; preferably freed from ammonia by water washing if necessary. The final heavy shale oil product of the visbreaking process is withdrawn through valve (and line) 11$^y$ and sent to storage for shipment by pipeline to the refinery which in the absence of the visbreaking process would be both impractical and non-feasible owing to congealing in cold weather due to paraffin waxes; and other compounds which undergo congealing when cooled.

It is stated in the above connection that no special provision is made, or need be made, in the process for storage of coke (as in the present cases) since the formation of the latter is minimized in the visbreaking process, and in fact practically eliminated. The chamber incidentally is of much smaller dimensions than that used in the cracking step of the process in the parent case, and of my issued patent. It is particularly noted and of especial importance in the visbreaking step that no recycle oil is passed through the heating coil as in the step of the patent process (described in the related patent and application). The visbreaking operation consists of a single pass only through the heating coil 14, of the heavy oil withdrawn from the bottom of the fractionator 8 whereas in the cracking operation the "unconverted" oil in the cracking system which is recycled back to the heating coil may for example be twice the volume (referred to as "reflux ratio") of the partially converted oil from the heating coil 14. The overall result is that in the "visbreaking" process the degree of conversion, regulated in addition generally by the use of milder temperatures is converted only to the extent of reducing the viscosity and the congealing temperature of the shale oil to permit transportation and storage of the same under the cold weather conditions prevailing in the oil shale deposits and mining regions.

The equipment of the visbreaking process also has a much greater degree of mobility in moving the same from one mine site to another as may be required in addition to bringing up the raw oil shale from various locations which would be required in both processes at the mine site. The present process (aside from the advantages of the proceeding process described above. is a novel continuous unitary one and performs a function at the mine site necessary to transfer the shale oil product by pipeline over long distances to be cracked in the variety of distillate products mentioned below, and which are later subjected to additional refining operations.

The process of the parent cases (the patent and pending application) referred to above although related differ from each other, and are novel unitary and continuous processes comprising several steps, in addition to the cracking step,. the wide variety of crude distillate products named below may be produced and sent directly to the refinery (without congealing) and require only simple refining steps to make the finished products.

The product of my present novel processes is thus amenable when necessary to treatment permitting it to be transported by pipeline to the refinery, under practically all weather and climate conditions, and there converted into marketable products by cracking and refining the "visbroken" shale oil. These products may include aviation fuels gasoline, (or motor fuels generally), burning or heating oils suitable as domestic fuels, diesel oils, jet fuels and similar distillate fuel oils suitable for various uses e.g. raw materials for petrochemicals and in general as alternate or substitute source for similar distillate products from petroleum on an adequate industrial scale.

SPECIFIC EXAMPLES: AND RESULTS

With regard to specific examples of visbreaking and results it is noted that in many cases crude shale oil will not flow satisfactorily below temperature ranges of about 85° F to 100° F and in order to overcome this undesirable situation it has been proposed in connection with development work in the field to provide heating stations at various intervals as well as force the oil through the pipeline at high velocity. It is also noted that most shale oils are quite fluid (low viscosity), only a few degrees above their setting points.

The following data shows the relationship with regard to setting points and specific gravity, which decreases and bears a direct relationship to setting point versus specific gravity by heat treatment and distillation of crude shale oil successively to coke.

Table #1

| Specific Gravity | | Setting Point ° F |
|---|---|---|
| Original | 0.922 | 99 |
| Run to Coke | 0.878 | 75 |
| Twice Run to Coke | 0.865 | 68 |

The data in the following table together with the data above illustrate the results of heat treatment and by visbreaking of shale oil at 800° F and 150 lbs. pressure for various periods of time of visbreaking.

Table #2

| Viscosity Breaking (Minutes) | Specific Gravity at 75° F |
|---|---|
| None | 0.8900 |
| 10 | 0.879 |
| 20 | 0.870 |
| 30 | 0.865 |

The above results (Table 1) shows a definite relationship between setting point and of the specific gravity on the one hand and Table 2 of the time of viscosity breaking and specific gravity on the other; confirming a general relationship with respect to increase of fluidity (low viscosity) when within only a few degrees above the setting point. Additional tests showed a rapid lowering of viscosity (Saybolt 122° F) over the same time range shown in Table 2 above; i.e., about five-fold in 10 minutes and about 10-fold in 20 minutes at about 800° F and 150 pounds pressure.

It may be remarked at this point that while my visbreaking process is preferably adapted to surface (above ground) retorting, as described by me herein, it may also be simply adapted if necessary to treatment of the product of other surface retorting processes, as well as "in situ" or underground retorting processes by simply heating the said shale oil in question (starting with by simply heating the said shale oil in question (starting with stored gas) and continuing by heat exchange with the hot gases of combustion from the retorting and visbreaking operation as thus described. The heated shale oil, water or low boiling hydrocarbons is introduced appropriately into the fractionator 8 and the operation proceeds as described herein.

It is noted in connection with all of the above that surface retorting and in situ or underground retorting represent two schools of thought and it may be remarked in passing that the "in situ" process appears to have obvious defects such as lack of control to produce shale oil from the underground oil shale deposits. Thus there is complete ignorance of actual shale oil yields based on complete utilization of the underground oil shale to product shale oil. This is because the heat used to distill oil shale to shale oil product comes from combustion of an unknown and indeterminate part of the underground oil shale as well as complete lack of control of the same. There are, of course, other problems in the above connection. The latter is true also of some surface operations referred to above where the combustion gases are used to heat the oil shale directly.

With reference to various phases of economy with emphasis on fuel at the mine source, use and disposition of spent shale and oil shale ash and other pertinent questions, the following additional remarks are noteworthy. It is noted that in this connection the spent shale is about 84% of the original oil shale, and the ash is about 61%, with about 23% of fixed carbon, but will vary somewhat with different shales.

With further regard to the producer gas operation to furnish fuel for self-sufficiency and economy of the process in providing fuel (in addition to the hydrocarbon gases produced) for the overall operation. The basis for this in the case of the producer gas is the conversion of the fixed carbon in the spent oil shale (amounting to about ¼ to ⅓ by weight of the latter depending on the oil shale), and its utilization for fuel. It also serves to clean up the spent shale for the other uses referred to below. In the producer gas process as discussed above, the spent shale passes from the retort in FIG. 1 and is carried by the conveyor (illustrated by the screw or ribbon type), 4*a* while still hot into the gas producer FIG. 4. The latter previously described may be defined as a vessel containing a thick layer of subdivided solid fuel, high in carbon, through which air or a mixture of air and steam is passed, with the object of converting the carbon of the spent oil shale to a gaseous fuel, illustrated by lines 4' and 4''. In this connection, when air is used alone, the fuel is largely carbon monoxide; when steam is added, hydrogen as well as additional carbon monoxide is formed so that the fuel mixture may be carbon monoxide and hydrogen with some nitrogen and carbon dioxide resulting from the reaction. Established principles in connection with both producer gas and water gas and combinations thereof are observed in this connection in addition to the novel uses in the present connection.

With regard to the flow of the shale ash from the gas producer, it may pass through the bottom of the producer 4a controlled by element 4*b* and passes over divider e, the major portion passing into spent shale storage for return to the mining excavation from which the oil shale is removed, in the interest of restored ecology, as well as being utilized for a large number of products and uses as set forth in my issued patent.

It must also be borne in mind that the gas resulting from the retorting of the shale oil itself as indicated above is an important source of high BTU fuel.

Another important source of fuel or heat is obtained by heat exchange of the combustion gases both from the retorts FIG. 1 and the heating operation for viscosity breaking connected with FIG. 2.

In addition to partial dehydration of the oil shale at relatively lower temperatures, a rapid rate of production of the oil vapors at somewhat higher temperatures is desirable from the viewpoint of capacity as well as yield. For example an oil yield of about 45 gallons per ton of shale in less than 2 hours at a temperature of about 970° F was observed whereas at about 870° F the time required to yield 42 gallons per ton was about 4 hours. It is also noteworthy that retorting at 850° F drops the yield still further. In this particular case the shale was partially reduced to various size (down to about 174 inch)which indicates a wider range in this respect. It is expected, therefore, that quick retorting, e.g, at between 950° F and 1000° F (i.e, at higher temperatures and shorter periods of time) could result in larger throughputs or capacity and less exposure of the oil vapors at high temperatures, all of which are important factors in the economy of high capacity oil shale operations. However, from the data to date, this type of operation, especially in addition to the partial dehydration as described herein, appears very promising especially in connection with much higher capacities of the high temperature retort section as a result of the operation referred to above. It is also noted in passing that the presence of some steam in the high temperature retort within limits is helpful both to rapid retorting and higher yields especially in connection with the novel design and use of retorts disclosed by me as well as conditions of operation particularly including the partial dehydration pretreatment of the oil shale disclosed herein. The operations connected therewith all lead to an industrialized oil shale industry not heretofore disclosed particularly from the viewpoint of capacity and of variety of fuel distillate products commensurate with the modern petroleum industry. It may also be further noted that as a measure of economy, the use of the oil shales fines, within limits, together with somewhat larger pieces 1 to 1.5 inches of oil shale tend to increase the quantity of oil proportionately and apparently reduces time of retorting. However, there is some evidence that too great a proportion of fines may reduce the overall yields of oil. In this connection it is pointed out that the fines may be employed as fuel if necessary, e.g. in connection with the retorts; much like powdered coal and the latter may likewise be employed if available and necessary for fuel and/or power. In any event, the sources of by-product processing fuel for all operations at the mine appears assured.

The novel process of the present invention permits the transport of the shale oil product by pipeline to the refinery where it may be refined into the products referred to above, utilizing cracking and refining equipment and making products already described in the parent cases; and to this extent in addition to facilitating transportation as well as defining operations at the refinery, and simplifying the operations at the mine. The latter is a very important factor in the development of a full scale fuel distillate industry from oil shale comparable in capacity to the present day operation in the petroleum industry; made possible by the novel features of the present invention.

As already pointed out above, it is highly desirable if not necessary, mainly from the operating as well as the economic viewpoint, to carry out the primary operations of my process in the vicinity of the deposits where the oil shale is mined because of the cost and impractability of transportation of the oil shale etc., the probable use of the oil shale ash as refill material and other important reasons rather than to locations otherwise more suitable on an all around basis for processing. However, the liquid products of my process may be piped to a conveniently located refinery for final treatment (e.g. cracking and refining) into marketable products as described.

The recovery of heat relates to either or both sections A and B of my process: a number of examples of which have already been set forth above; and others which may be utilized. I have already pointed out a number of such sources of heat and valuable uses of otherwise waste heat which should suffice as examples thereof.

It is time that the question of re-allocation of water be made on a practical basis, (having in mind also that the Colorado River rises in the major oil shale area, namely the Green River Formation); as well as the critical nature of the problem to the welfare of the nation. Moreover, this problem may be largely resolved by the application of elementary water technology e.g., a reservoir (preferably at a higher elevation) for cooling by recirculation, and the use of by-products for occasional treatment of the water if necessary. Similar elementary devices such as overhead "trolley and cable" transportation may be found useful in moving shale for treatment and/or waste products for fill.

As stated above and indicated in the drawings the horizontal cylindrical vessels employed slope downwardly to "induce passage and discharge of the oil shale undergoing treatment" hence the expression in the claims the "*substantially* horizontal cylindrical vessels" implies sufficient slope to carry out the above functions of passage during treatment of the oil shale and discharge of the same thereafter.

Having described my invention and modifications thereof in considerable detail, it is noted that it should not be limited thereby, but should be interpreted in accordance with the broad scope and spirit of the same; as well as for its great importance both to our present and prospective future energy situation; and to a high degree the future independence of the nation in respect thereto.

I claim:

1. A continuous process for the production of the shale oil and other products from oil shale which includes removing a relatively large to major amount of the water present in oil shale prior to recovery of the oil by retorting the same to facilitate the rate of recovery of the oil therefrom in the retorting step of the process and to substantially increase the capacity of the latter step in the process which comprises subjecting the said oil shale in subdivided form to heat treatment in a partial dehydration step under relatively milder temperature conditions than that of the retorting step, said partial dehydration step being conduct while rotating the oil shale in a substantially horizontal cylindrical vessel collecting the vapors and gases from the partial dehydration step in the temperature range up to about 550° F to 650° F to remove relatively large to major amounts of free and combined water from the oil shale, and thereafter passing the heated partially dehydrated oil shale to the retorting step for further heat treatment at a substantially higher temperature than that of the dehydration step, in the approximate range of about 800° F to 1000° F, said heat treatments in the partial dehydration and retorting steps, being effected by indirect heat exchange with hot gas, said further heat treatment being conducted while rotating the partially dehydrated oil shale in a substantially horizontal cylindrical vessel withdrawing the vapors and gaseous products resulting from the heat treatment of the same partial dehydration and retorting steps of the process from said rotating substantially horizontal cylindrical vessels, fractionating the vapors withdrawn from the retort whereby there is removed a light overhead product comprising vapors of low boiling hydrocarbons, water, hydrocarbon gases and ammonia and wherein the heavier conversion oil products from the oil shale are condensed and separated as a liquid for further treatment and use.

2. The process of claim 1 wherein the heat treatment in the dehydration system is an indirect heat treatment.

3. The process of claim 2 wherein the indirect heat treatment is with hot combustion gases.

4. The process of claim 1 wherein a major amount of the water present in oil shale is removed.

5. The process of claim 1 wherein the heat treatment in the partial dehydration system is at a temperature of up to and about 550° F to 650° F and wherein the further heat treatment in retorting is at a temperature up to about 850° F to 1000° F.

6. A continuous process for removing a relatively large to major amount of the water present in oil shale prior to retorting the same to facilitate the rate of recovery of the oil therefrom in the retorting stage of the process and to substantially increase the capacity of the latter step in the process which comprises subjecting the said oil shale in subdivided form to heat treatment in a partial dehydration step under temperature conditions in the range of up to about 550° F to 650° F collecting the vapors and gases from the partial dehydration step and passing the heated oil shale to a retort for further heat treatment at a substantially higher temperature than that of the partial dehydration step in the temperature range up to about 800° F to 1000° F, wherein the said heat treatments in the partial dehydration and retorting steps are by indirect heat exchange with hot gas, and the hot combustion and flue gases therefrom are not in direct contact with the oil shale and the vapors and gaseous products resulting from the heat treatment of the same, fractionating the vapors withdrawn from the retort wherein there is removed a light overhead product comprising vapors of low boiling hydrocarbons, water, hydrocarbon gases and ammonia which are recovered and wherein the heavier conversion products from the oil shale are condensed and separated as a liquid, passing the said hot condensed heavier oil products through a separate heating zone comprising a heating coil and enlarged chamber maintained under viscosity breaking conditions to reduce congealing tendencies by heating at elevated temperatures in the range of about 700° F to 900° F and pressures in the range of about 100 to about 200 pounds, with no recycling of the heated oil, and thereafter cooling and collecting the resulting improved shale oil product.

7. The process of claim 6 wherein a major amount of the water present in oil shale is removed in the partial dehydration step.

8. The process of claim 6 wherein a portion of the stream of hot condensed heavier products passing through the said heating coil may be diverted from said enlarged chamber and thereafter cooling and collecting the shale oil product of the process.

9. The process of claim 6 wherein the indirect heat treatment in the partial dehydration system is done with the hot combustion gases from the said retorting step.

* * * * *